United States Patent [19]

Du Bois et al.

[11] 4,177,666

[45] Dec. 11, 1979

[54] METHOD AND APPARATUS FOR SAFELY FEEDING A MACHINE MANUALLY

[75] Inventors: Edward F. Du Bois; Arthur L. Papastrat, both of Binghamton, N.Y.

[73] Assignee: The Singer Company, Binghamton, N.Y.

[21] Appl. No.: 899,145

[22] Filed: Apr. 24, 1978

[51] Int. Cl.[2] ..... B21D 43/04; B21D 5/02; B21D 55/00

[52] U.S. Cl. ..... 72/420; 72/389; 72/419; 100/53; 83/437; 72/DIG. 11

[58] Field of Search ..... 72/DIG. 21, 419, 420, 72/412–414, 389, 386, DIG. 11; 192/129 R, 130, 131 H, 131 R; 83/431, 435.1, 437; 100/53

[56] References Cited

U.S. PATENT DOCUMENTS

| | | | |
|---|---|---|---|
| 8,163 | 4/1878 | Hyslop, Jr. | 72/414 X |
| 1,831,124 | 11/1931 | Koster | 83/435.1 |
| 2,237,556 | 4/1941 | Hedgpeth | 83/437 |
| 2,364,969 | 12/1944 | Grob et al. | 83/437 X |
| 2,730,173 | 1/1956 | Brescka | 192/129 R |
| 2,739,625 | 3/1956 | Peters | 83/437 X |
| 2,785,709 | 3/1957 | Shepp | 83/435.1 |
| 4,070,940 | 1/1978 | McDaniels et al. | 192/130 X |
| 4,114,418 | 9/1978 | Jarman | 72/421 X |

*Primary Examiner*—Francis S. Husar
*Assistant Examiner*—D. M. Gurley
*Attorney, Agent, or Firm*—J. Dennis Moore; Richard J. Paciulan; Jeff Rothenberg

[57] ABSTRACT

Material to be manually fed into a machine's point of operation is supported by a surface plate. A pusher, interrelated with the surface plate by keying means, is held by the machine operator such that the operator uses the pusher to push the material into the machine point of operation without having the operator's hands coming in dangerous proximity with the machine point of operation or with the machine's structure.

7 Claims, 8 Drawing Figures

METHOD AND APPARATUS FOR SAFELY FEEDING A MACHINE MANUALLY

BACKGROUND OF THE INVENTION

1. Field of the Invention

This invention relates to feeding material into a machine and more particularly to feeding material into a press type machine such as a press brake in such a manner that an operator maintains control over the material being inserted without risk of injury.

2. Description of the Prior Art

It is a common occurrence in modern industry for material in one shape or form to be converted into another shape or form. Many base materials such as aluminum or steel are typically supplied by material vendors in the form of sheet stock. This sheet stock is then processed so that a functional device may be fabricated from the material. The material will be cut, punched, bent, drawn, or squeezed, according to need. Many manufacturing shops accomplish their shape conversion by using presses, machines that supply pressure to accomplish the work required. A particular type press, a press brake, is a machine used for bending, folding, and forming sheet material, by applying pressure.

The press brake presses material between two pieces of a preset die such that the material takes a shape determined by the shape of the die pieces. Typical press brakes have pressure capacities ranging from 25 tons to several thousand tons. These large pressure magnitudes are indicative of the forces applied to the material inserted between the dies to overcome the strength of the material and to firmly form the desired shape.

Most modern press brakes are designed to be manually fed by an operator. The operator holds the material to be shaped with his hands and feeds the material between the die pieces, an area designated as the point of operation. If the material being shaped is small, the operator must place his hands close to the point of operation when holding the material as it is being fed into the machine. The press is then activated and the forces are applied to the material. In some cases the material being held by the operator will tend to move at the holding point as the forces of the dies shape the material. When large forces distort hand-held material in close proximity to the point of operation, a potential hazard exists. Injury to the operator may occur. There exists for many machines, and particularly press brakes, areas designated danger zones, within which a hazard may occur under normal operating conditions. In a press brake, for example, areas where the operator could accidentally jam his hands between the press brake dies or where the bending forces could pin his hands against the brake press structure while he is holding the material, are considered danger zones.

The prior art has developed many approaches to protect a press brake operator in the danger zones. Light beam sensors, for example, have been employed whereby light is directed at the point of operation and the pressing action shut down when a solid element, such as a hand, triggers the device. This method becomes impractical as the material itself can trigger the device.

Pull-out devices have been used whereby the operator's hands are restrained by ropes and are pulled back when the hands approach a specified distance from the point of operation. This device, as it physically withdraws the hands, creates another hazard. Hand injuries can easily result when the hands are forced back while material is turning or twisting in the operator's grip. Furthermore, rope restraints severely limit general operator freedom of motion.

There has also been employed hand-held tongs for gripping the material, some tongs having a universal joint that will pivot when the material is moving during shaping. These tongs have disadvantages in that small pieces become awkward to control and, since the universal joint type tongs can readily pivot, forces required to direct material in the direction of the point of operation are weak.

Therefore, a need exists for a simple, safe approach that can be used by a machine operator when manually feeding material into a machine, and particularly for feeding material into a press type machine such as a press brake.

SUMMARY OF THE INVENTION

It is therefore a principal object of the present invention to provide a method and apparatus for manually feeding material into a machine, particularly press type machines, such as brakes, such that the machine operator maintains control over the material without incurring risk of injury.

It is another object of the present invention to provide a simple, inexpensive, method and apparatus for manually feeding material into a machine such that the operator's freedom of motion is not inhibited.

It is another object of the present invention to provide a method and apparatus for feeding material into a machine that allows sheet material of varying dimensions and various material having a bulk form to be safely and controllably inserted into the machine point of operation while keeping the operator's hands outside of the machine danger zone.

It is still another object of the present invention to provide a method and apparatus for manually feeding material into a machine that is easily adaptable to machines having various size points of operation.

It is still another object of the present invention to provide a method and apparatus for manually feeding material into a machine that allows for easy apparatus storage when not in use.

According to the present invention, material that is to be fed into a machine's point of operation, such as between a press brake die set, is supported on an adjustable surface plate. The surface plate may be repositioned so that material can be easily inserted into various size points of operation, such as those produced by various size press brake die sets, or situated in a storage position when not in use. A pusher, having a pushing surface for contacting the material being inserted and a holding surface or handle held by the machine operator, is manually controlled by the operator such that he directs the pusher into contact with the material. One or more pushers, each having a keying element interacting with a complementary keying member located on the surface plate, directs the material into the machine point of operation. The pushing surface may have an adjustable contact area such that, for example, a second contact area for inserting material having a bulk form can be added to a first contact area that is used to insert sheet size material. The pusher holding surface is separated from the pushing surface such that as the material is pushed into the machine point of operation the operator's hands do not come in dangerous proximity with the machine point of operation or with the machine's structure.

The foregoing and other features and advantages will become more apparent in light of the following detailed description of the preferred embodiment thereof as illustrated in the accompanying drawings.

DETAILED DESCRIPTION

Figure 1A:
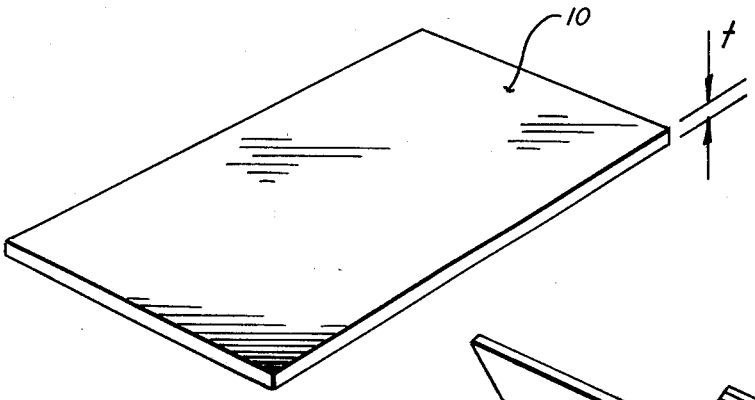
FIGS. 1A and 1B show sheet material before and after bending.
Figure 1B:
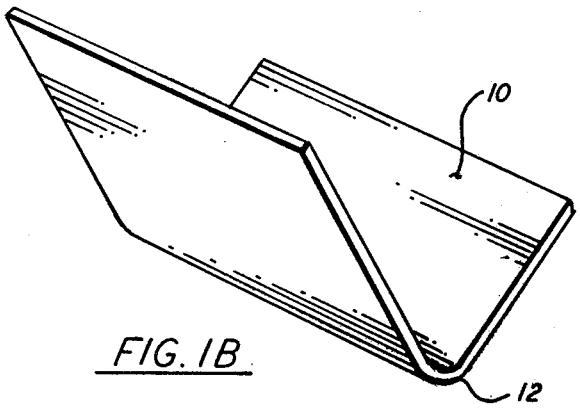

In manufacturing various piece parts large amounts of force are usually required to form desired shapes from certain base materials, such as metals. One common shape conversion is that of transforming sheet metal into a bend or corner. In FIG. 1A a metal sheet 10 is shown in a typical stock form, namely a flat rectangular sheet whose thickness t could vary in common fractional sizes, typically less than two inches. Referring to FIG. 1B, sheet 10, if desired, might be converted into a form having a bend 12. In many modern machine shops one type machine used to supply required forces necessary to form desired shapes is a press. A common type press used for bending, folding, and forming sheet metal is the press brake. The press brake can be used to produce the shaped metal sheet 10 shown in FIG. 1B.

Figure 2:
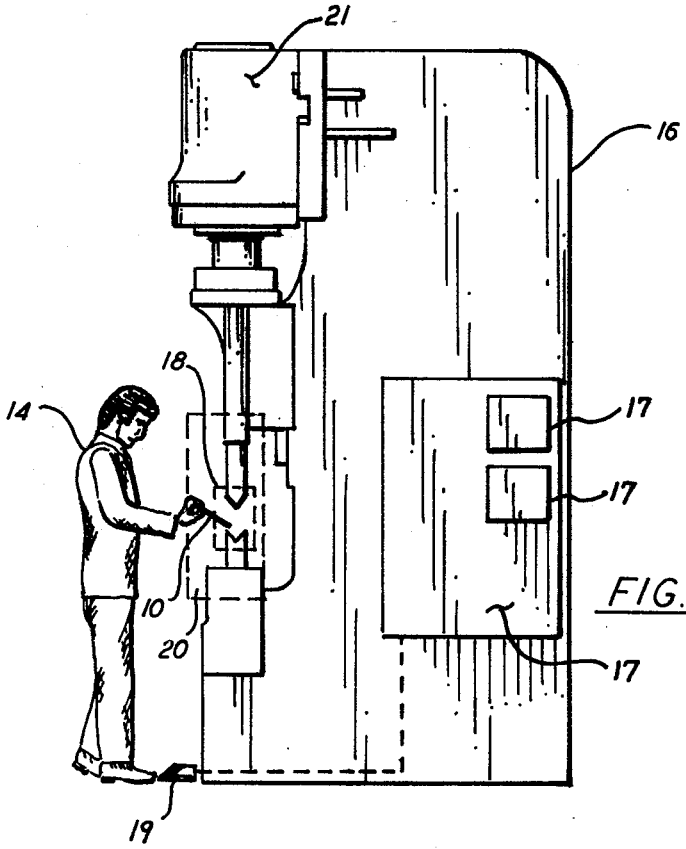
FIG. 2 shows a press brake and an operator feeding material into the press brake.

Modern press brakes are typically large machines that deliver large magnitudes of force to a confined area. The material being shaped is inserted into the confined area and the force is applied to accomplish the desired shaping. Referring to FIG. 2, a machine operator 14 is shown manually inserting into press brake 16 a sheet 10 that is to be formed. When press brake controls 17 are activated, typically by foot pedal 19, press brake internal mechanisms develop these large magnitudes of force. Driving mechanisms located in housing 21 propel the forces toward the sheet to be formed.

Figure 3:
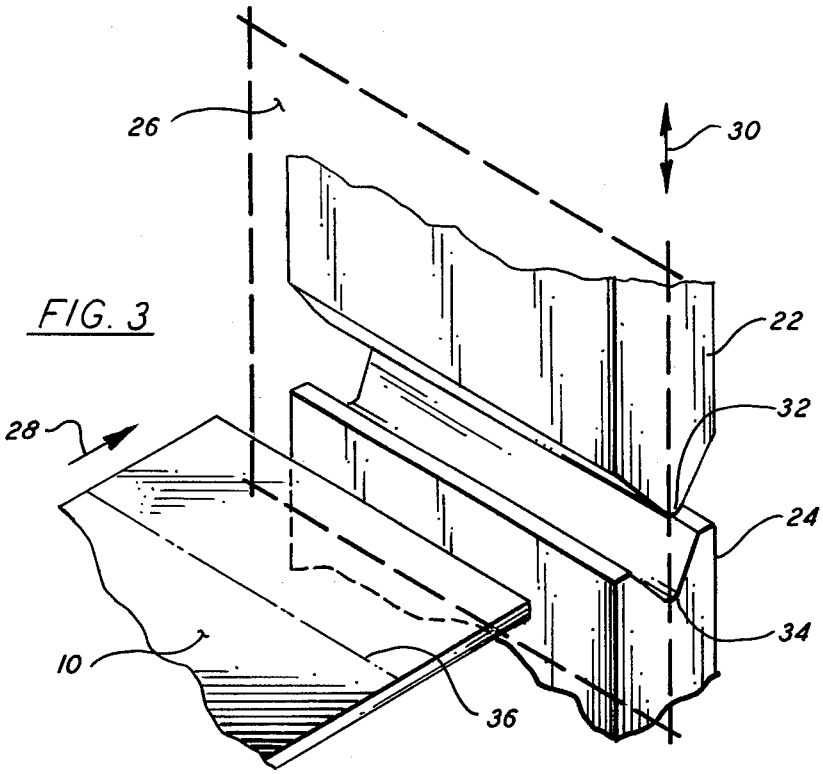
FIG. 3 shows a detailed perspective view of the press brake point of operation.
Figure 4:
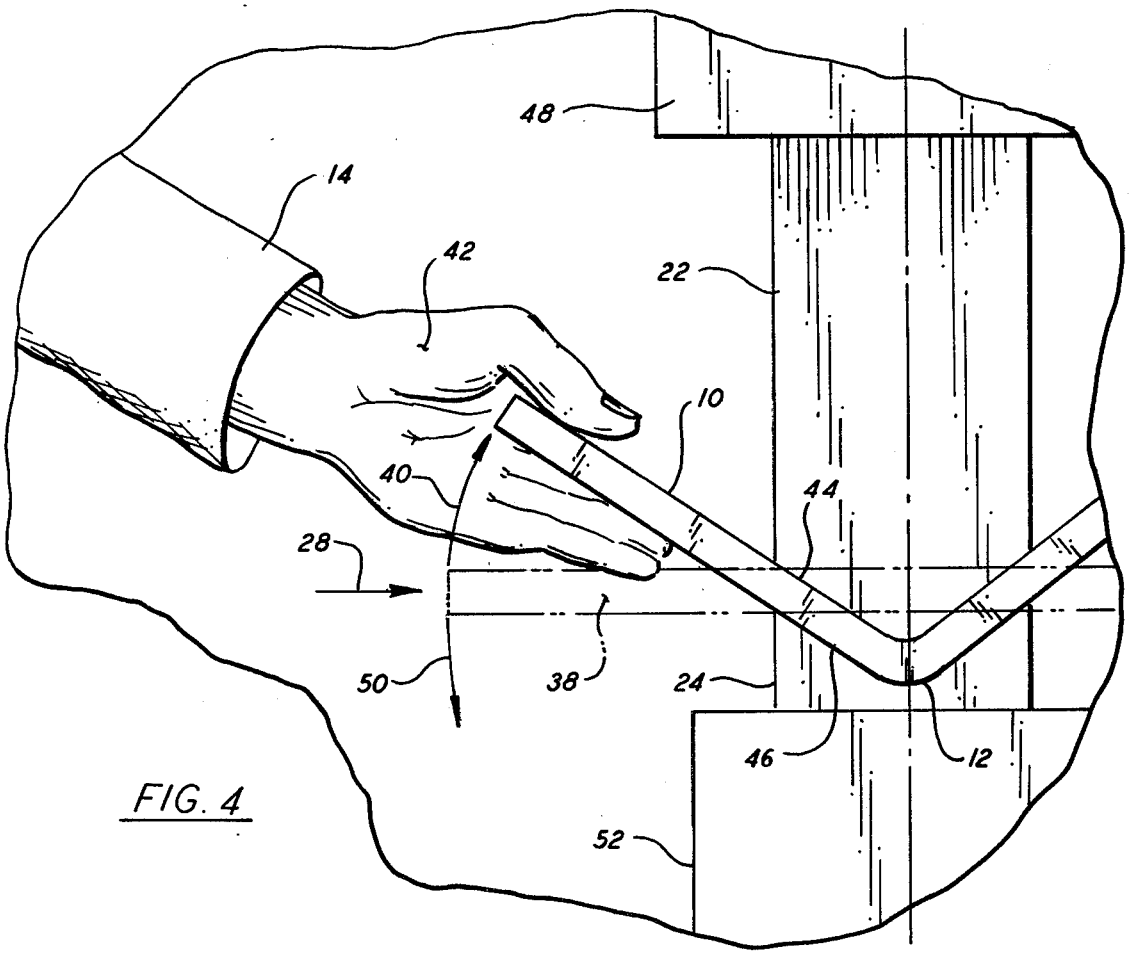
FIG. 4 shows the press brake point of operation bending sheet material.

Press brake 16 has a point of operation 18 and a danger zone 20. The point of operation is that area on the machine where the work is actually performed upon the material being processed. The danger zone is that area where a potential injury might occur when the machine operator is employing the press brake under normal operating conditions. Referring to FIGS. 3 and 4, the details of the point of operation and the danger zone will be explained.

In FIG. 3 is shown a detailed perspective view of point of operation 18 of FIG. 2. Two pieces of a preset die pair, a ram 22 and a base 24 are used to perform the shaping on sheet material 10 inserted into the point of operation along direction 28. Base 24 is held stationary with respect to the press brake structure. Ram 22 is driven in plane 26 along direction 30. Sheet 10 passes through plane 26 such that a desired bend having a shape defined by an inner contour 32 from ram 22 and an outer contour 34 from base 24 is to be located at location 36 on sheet 10. Force is applied to ram 22 causing it to travel within plane 26 toward the base 24. The forces produced by the die set, sometimes several thousand tons, will form the desired shape on the material inserted.

FIG. 4 shows ram 22 and base 24 forming sheet 10. Operator 14 had inserted sheet 10 along direction 28 and the sheet was held at position 38 prior to ram impact. After impact, sheet 10 developed bend 12, and due to the shaping forces, projected sheet 10 from position 38 along direction 40. Since operator 14 was holding sheet 10 before and during the pressing operation operator hand 42 travelled with sheet 10 along direction 40. It can be seen from FIG. 4 that a danger zone area exists where a potential injury might occur when the machine operator is employing the press brake under normal conditions. Since operator hand 42 must hold sheet 10 while inserting the material into the point of operation, a potential injury could occur if hand 42 was pinched between ram 22 and sheet 10 along surface 44 or between base 24 and sheet 10 along surface 46. Furthermore, since the forming forces can cause the sheet to travel along direction 40, hand 42 has the potential of being pinched between ram 22 and sheet 10 or between press brake structure 48 and sheet 10. Since the bend could also occur such that a direction 50 is followed, hand 42 has the potential of being pinched between sheet 10 and either base 24 or press brake structure 52. Therefore, the danger zone in FIG. 2 must include the area at the point of operation and also a portion of the press brake structure surrounding the point of operation.

Figure 5:
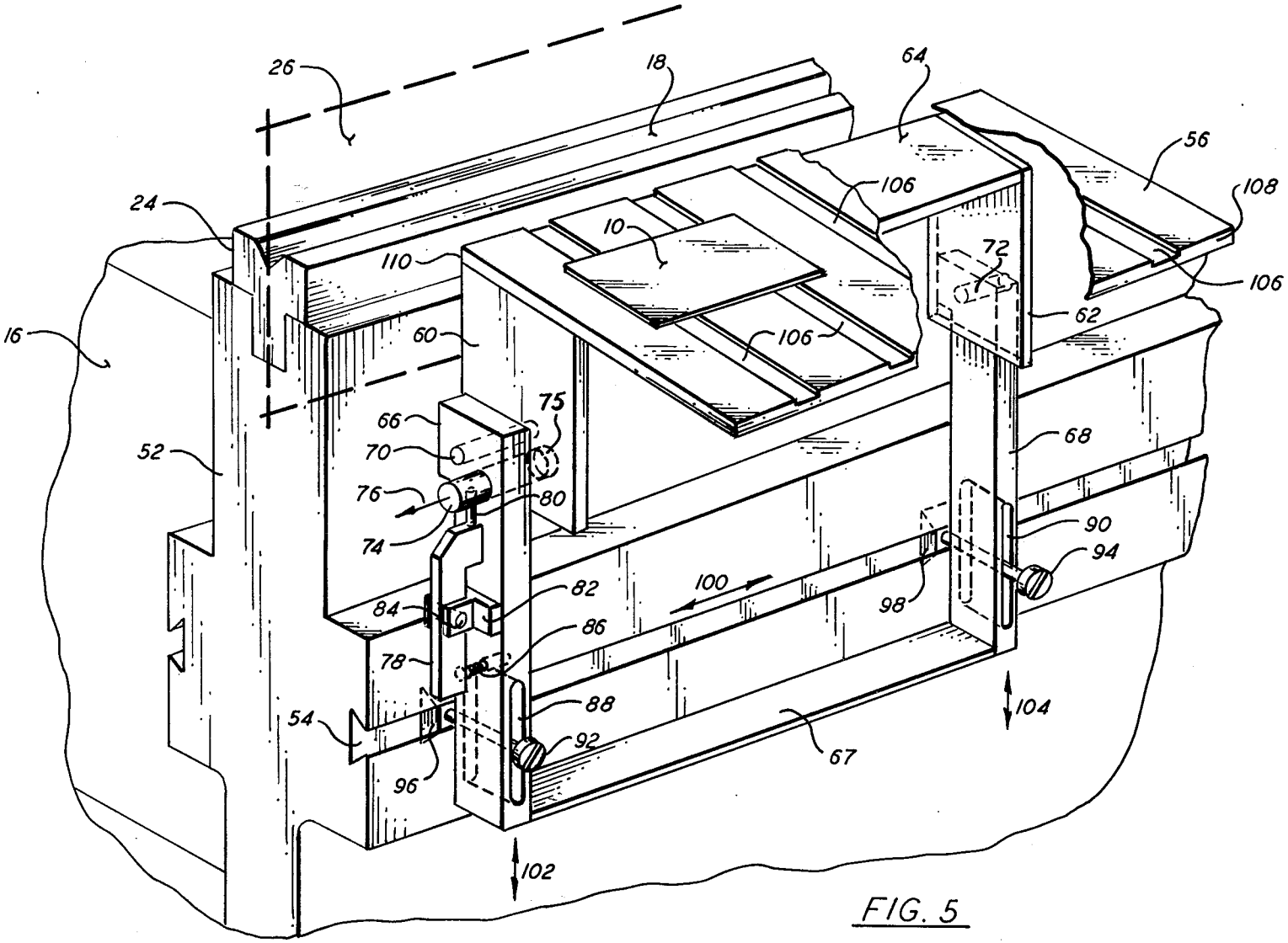
FIG. 5 shows one aspect of the preferred embodiment of the present invention.

The instant invention is designed to prevent injury to the operator's person by precluding insertion of his hand into the danger zone. In FIG. 5 is shown one aspect of the preferred embodiment of the present invention. Press brake 16 has a press brake structure 52 which holds in place die base 24. A ram (not shown) travels in plane 26. A typical press brake, such as a Dreis and Krump model 300F12, contains a dovetail slot 54 incorporated into structure 52. According to the preferred embodiment of the present invention a surface plate 56 supports sheet material 10 that is to be bent in the point of operation 18. Pivot blocks 60 and 62 and bar 64 are connected to and support surface plate 56. Support legs 66 and 68 are held adjacent to pivot blocks 60 and 62 respectively and are connected thereto through pivot pins 70 and 72. Pivot pins 70 and 72 allow blocks 60 and 62 to swing about these pins so that surface plate 56 can be stored, when not in use, in a position parallel with plane 26. A stop pin 74 passes through leg 66 and engages a recess 75 in block 60 so that block 60 will not pivot about pin 70 when surface plate 56 is in use. When surface plate 56 is to be stored, stop pin 74 is extracted from recess 75 along direction 76 disengaging block 60.

The stop pin travel is accomplished using lever 78. A pin 80 connects stop pin 74 and upper portion of lever 78. Bracket 82 is affixed to leg 66 and cradles lever 78. Passing through lever 78 and bracket 82 is lever pivot pin 84. When the lower portion of lever 78 (as shown in FIG. 5) is pushed toward leg 66, the upper portion of lever arm 78 will pivot on pin 84 causing pin 80 to pull stop pin 74 along direction 76 allowing surface plate 56 to pivot. A spring 86 is located in leg 66 and protrudes from leg 66 such that spring 86 forces lever 78 into a stop pin locking position when force is not applied to lever 78.

Since various size die bases 24 may be interchanged on the press brake for forming various shapes, the location of surface plate 56 relative to press brake structure 52 must be adjustable so that the material being formed will have easy access to the point of operation 18. According to the present invention legs 66 and 68 contain slots 88 and 90 respectively. Fastening screws 92 and 94 protrude through slots 88 and 90 respectively and engage corresponding dovetail nuts 96 and 98 which are located in dovetail slot 54. By loosening nuts 96 and 98 legs 66 and 68 can travel along direction 100 or along directions 102 and 104. This travel enables surface plate 56 to be easily situated in any desired position. Bar 67 braces legs 66 and 68 for additional support.

Surface plate 56 also contains a series of keying grooves 106 located on the surface where material 10 is supported. The keying grooves are rectangular parallel channels extending across the surface plate from end 108 toward end 110 which is adjacent to point of operation 18. These keying grooves are used to maintain a travel path for a pusher as shown in FIG. 6.

Figure 6:
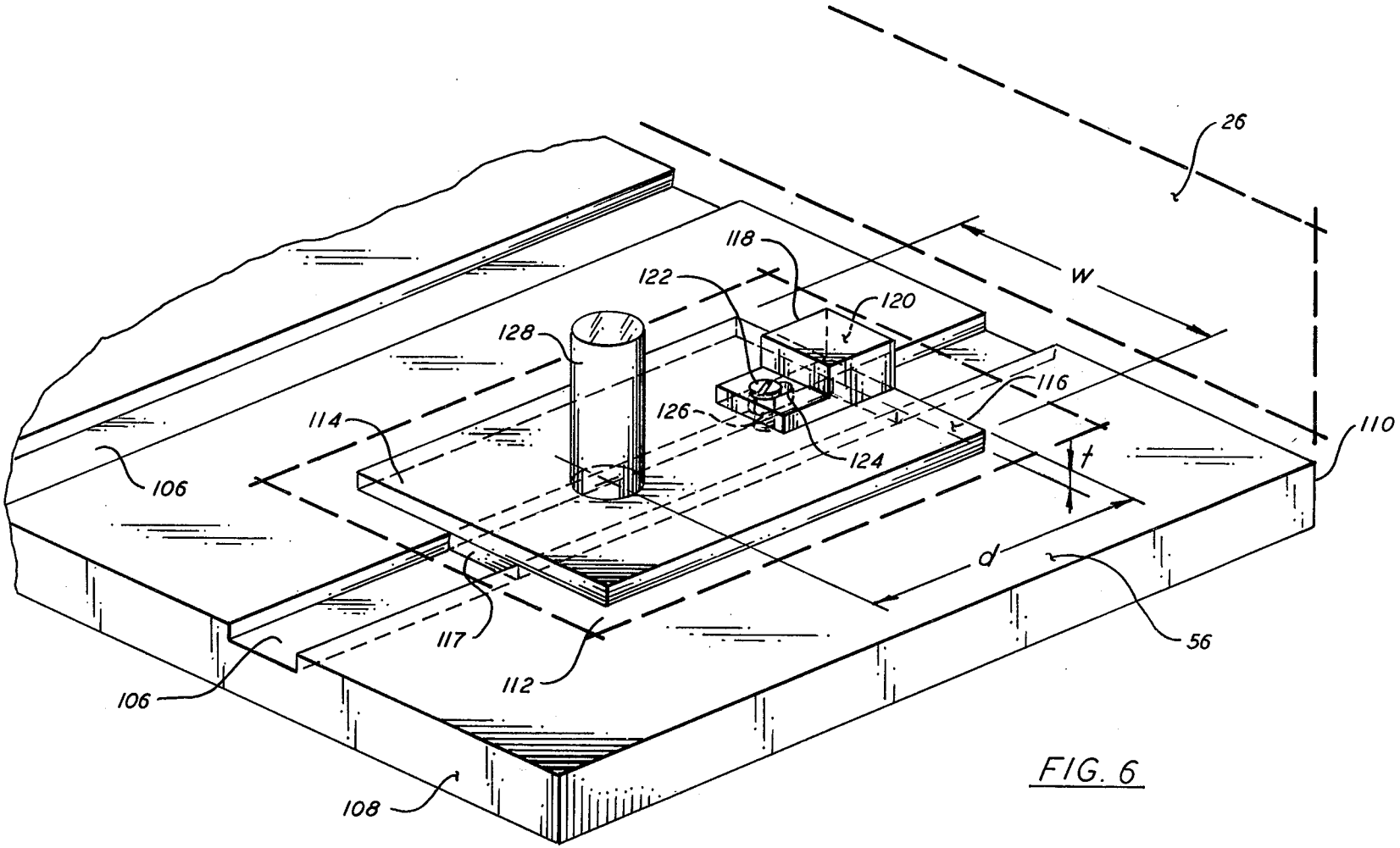
FIG. 6 shows a second aspect of the preferred embodiment of the present invention.

Referring to FIG. 6, surface plate 56 is shown containing channels 106. A pusher 112 lies on surface plate 56. Pusher 112 has a body 114 containing pushing surface 116 for contacting the sheet material (not shown) that would be inserted toward plane 26 and the point of operation. Pusher 112 also has a keying element or ridge 117 affixed to body 114 with the ridge capable of seating within any one of keying grooves 106 such that the pusher can freely travel in essentially a straight line from surface plate end 108 to surface plate end 110. The keying devices allow a predetermined pusher travel path to be maintained relative to the surface plate.

Attached to pusher body 114 is block 118 having a pushing surface 120 for contacting material to be inserted. Block 118 is attached to body 114 by screw 122 which passes through block slot 124 and engages threaded hole 126 in body 114. When screw 122 is loosened, block 118 can be slid toward the point of operation so that surface 120 can join surface 116 to form a composite surface. Body 114 is conveniently dimensioned such that surface 116 has a thickness t, essentially equal to that of the sheet material. Surface area 116 is therefore all that is needed to push sheet material to the point of operation. However, during secondary bending operations, for instance, where two consecutive bends are necessary, the material to be inserted will have a bulk form rather than a sheet form, since forming one bend will have created a "V" type shape rather than a flat sheet. In this case a larger area than that of surface 116 alone would be required so that one leg of the "V" shape is pushed while the other leg is being bent, otherwise the small surface 116 might tend to slide under the bent corner as the pusher pushed the material. Surface area 120 does not require a width the same size of surface 116, which can be any convenient width "w". The width of surface area 120 is typically kept less than width "w" so as to minimize drag on surface 120 when the material moves off the surface plate upon ram impact.

Still referring to FIG. 6, pusher body 114 also contains a holding surface such that when an operator is manually holding the pusher at the holding surface, material can be directed into the point of operation without brighing the operator's hands in dangerous proximity with the point of operation or with the press brake structure. In the preferred embodiment of the present invention a cylindrical holding surface 128 protrudes from the pusher body and is located at a distance d from pusher surface 116. With d equal to a distance, e.g., essentially 10 inches or greater, the holding surface is a sufficient distance from the point of operation so that the operator's hands do not come within the press brake danger zone.

Figure 7:
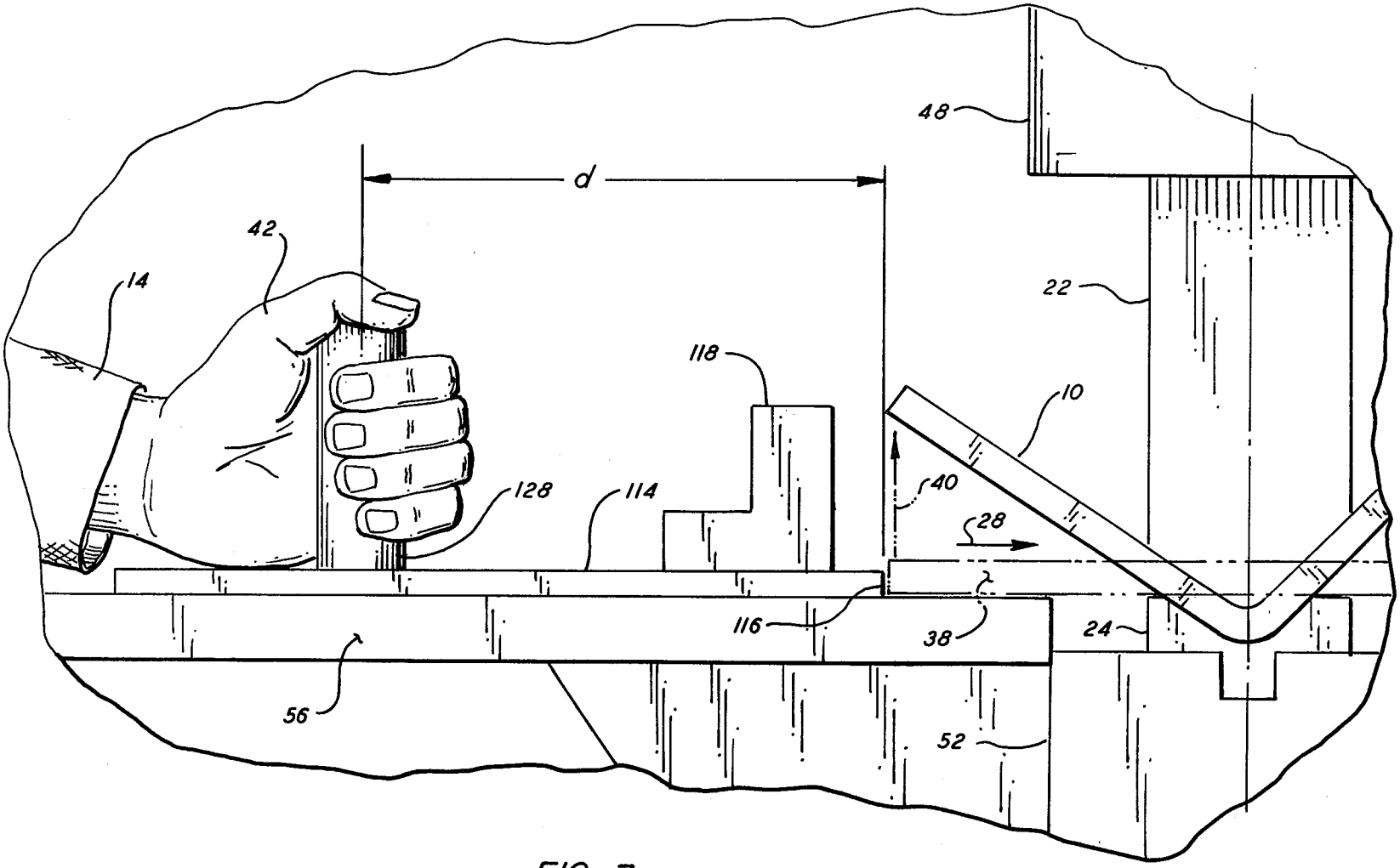
FIG. 7 shows the press brake point of operation bending sheet metal with the point of operation being fed by an operator employing the preferred embodiment of the present invention.

FIG. 7 shows the operation of the present invention and its safety features. Ram 22 and base 24 will form sheet 10. Hand 42 of operator 14 holds pusher body 114 by holding surface 128 to manually direct sheet 10, which was lying on surface plate 56 at position 38, in the direction 28. When the operator pushes the pusher, contacing surface 116 projects sheet 10 toward the point of operation. (Block 118 is not contributing to any composite surface since the pusher is pushing a sheet for its first bending operation.) When sheet 10 is in the point of operation ram 22 applies the forming force. Sheet 10 takes the shape of the die set and the sheet position changes in the direction 40.

Since hand 42 is separated from pushing surface 116 by distance d, hand 42 does not come near the point of operation while still maintaining control of the material being inserted. Since the operator's hand does not contact the material the hand cannot be pinched between ram 22 and sheet 10 or between base 24 and sheet 10, nor can the hand be pinched between sheet 10 and either brake press structures 48 and 52.

By incorporating the simple, inexpensive preferred embodiment of the present invention, namely, using the surface plate and pusher for manually feeding material into a press brake, particularly small pieces, the press brake operator can easily maintain control over the material while the material is being formed, without risk of injury and still maintain his freedom of motion. He can manually feed material into various size points of operation, and he can easily store the apparatus when not in use.

This invention has been described in terms of a press brake being used to bend sheet metal. However, it will be readily apparent to those skilled in the art that the present invention can be practiced with various machines where material is manually fed into the machine's point of operation and the machine operator must maintain control over the material being inserted without incurring risk of hand injury. It will be also apparent to those skilled in the art that various changes and modifications can be made without departing from the invention. For example, one pusher and one keying groove could be employed, or a pair of pushers, one held in each hand, each engaging any one of a series of keying grooves, could be implemented. The keying channel could be incorporated into the pusher and keying ridges located on the surface plate. Various other keying devices could be employed. The surface plate need not be affixed to the machine structure but could be supported by legs and could be rolled away instead of being pivoted for storage. Various sizes and shapes of the pusher, pushing surface, holding surface, surface plate, keying ridge, keying channels, surface plate support, and pivot mechanisms, all could be used to practice the present invention. The invention is, therefore, intended to cover all such changes and modifications as fall within the true spirit and scope of the invention as defined by the appended claims.

We claim:

1. A press brake safety apparatus for safely inserting sheet material into the point of operation of a press brake having a danger zone, comprising:

(a) a surface plate for supporting the sheet material to be inserted into the press brake;

(b) a pusher, comprising:

(1) a pusher body for sliding along said surface plate, having a first pusher surface with a thickness of the order of the thickness of the sheet material being inserted, for abutment against the sheet material, (2) a vertical surface element having a second pusher surface of substantially greater thickness than said first pusher surface, adjustably mounted on said pusher body and movable between a first position in which said second pusher surface coincides with said first pusher surface to form a composite pusher surface, and a second position in which said second pusher surface is recessed from said first pusher surface, and (3) a handle, integral with said pusher body and located a sufficient distance from said first pusher surface such that the hand of the operator holding said handle will not enter the danger zone while using said pusher; and (c) keying means interrelating said pusher and said surface plate and situated such that a predetermined pusher travel path is maintained relative to said surface plate.

2. The apparatus of claim 1, further comprising adjustment means for adjustably positioning said surface plate relative to the press brake so as to permit insertion of the sheet material into points of operation of various sizes.

3. The apparatus of claim 2 wherein said adjustment means comprises fastening means for adjustably fastening said surface plate to said machine's structure.

4. The apparatus of claim 1 further comprising:

pivot means for pivoting said surface plate such that said surface plate can be pivoted to a storage position while not in use.

5. The apparatus of claim 4 wherein said pivot means further comprises:

(a) fastening means for connecting said surface plate to said machine's structure while permitting said pivoting; and (b) locking means for releasably locking said surface plate into position for use.

6. A method of manually inserting sheet material into the point of operation of a press brake having a danger zone without exposing the operator to a risk of injury, wherein said sheet of material is to be bent more than once, comprising the steps of:

(a) Supporting the material on a planar surface such that the material is accessible to said press brake point of operation;

(b) providing a pusher having a first pusher surface which has a thickness of the order of the thickness of the sheet material; a second, substantially thicker pusher surface adjustably mounted on said pusher such that said second pusher surface may be set to coincide with said first pusher surface or be substantially recessed therefrom; and a handle disposed a sufficient distance from said first pusher surface such that the hand of the operator holding said handle will not enter the danger zone while said pusher is being used;

(c) setting said second pusher surface to a position substantially recessed from said first pusher surface;

(d) manually pushing said material into the press brake with said pusher, whereby the sheet material when bent in the point of operation will move away from the pusher without dragging on said first pusher surface;

(e) supporting the bent sheet of material on said planar surface so that an upright surface is presented to the operator and the material is accessible to said press brake point of operation;

(f) setting said second pusher surface to coincide with said first pusher surface;

(g) pushing the upright sheet material surface with said pusher, whereby said second pusher surface will abut said upright surface and said bent sheet material will not tend to slide over said second pusher surface when pushed by said pusher, and whereby the hands of said operator will not enter the danger zone when said pusher is so used.

7. The method of claim 6 further comprising the step of interrelating said pusher and said planar surface by keying means such that a predetermined pusher travel path is maintained relative to said planar surface.

* * * * *